US011046090B2

(12) United States Patent
Mori

(10) Patent No.: US 11,046,090 B2
(45) Date of Patent: Jun. 29, 2021

(54) PRINTER

(71) Applicants: CITIZEN WATCH CO., LTD., Tokyo (JP); CITIZEN SYSTEMS JAPAN CO., LTD., Tokyo (JP)

(72) Inventor: Yasuyuki Mori, Higashikurume (JP)

(73) Assignees: CITIZEN WATCH CO., LTD., Tokyo (JP); CITIZEN SYSTEMS JAPAN CO., Tokyo (JP)

( * ) Notice: Subject to any disclaimer, the term of this patent is extended or adjusted under 35 U.S.C. 154(b) by 0 days.

(21) Appl. No.: 16/649,655

(22) PCT Filed: Sep. 25, 2018

(86) PCT No.: PCT/JP2018/035455
§ 371 (c)(1),
(2) Date: Mar. 22, 2020

(87) PCT Pub. No.: WO2019/065632
PCT Pub. Date: Apr. 4, 2019

(65) Prior Publication Data

US 2020/0316960 A1 Oct. 8, 2020

(30) Foreign Application Priority Data

Sep. 27, 2017 (JP) ..... JP2017-185767

(51) Int. Cl.
*B41J 2/325* (2006.01)
*B41J 17/24* (2006.01)

(52) U.S. Cl.
CPC ..... *B41J 2/325* (2013.01); *B41J 17/24* (2013.01)

(58) Field of Classification Search
CPC ..... B41J 2/325; B41J 17/24
See application file for complete search history.

(56) References Cited

U.S. PATENT DOCUMENTS 5,052,832 A * 10/1991 Akiyama ..... B41J 3/36 400/193
6,129,463 A * 10/2000 Lau ..... B41J 17/32 400/234

(Continued)

FOREIGN PATENT DOCUMENTS

JP S63-101555 U 7/1988
JP 2007-268815 A 10/2007

(Continued)

OTHER PUBLICATIONS

International Search Report from corresponding International Patent Application No. PCT/JP2018/035455, dated Nov. 13, 2018, 4 pages.

*Primary Examiner* — Jason S Uhlenhake
(74) *Attorney, Agent, or Firm* — Tucker Ellis LLP

(57) ABSTRACT

A printer includes a body; a cover configured to open and close relative to the body; a winding shaft in the cover for winding an ink ribbon; a regulation member in the cover to change a position in accordance with an open and closed state of the cover; a passive member connected to an end of the winding shaft to receive driving force; and a ribbon flange provided axially inside the passive member to rotate with the winding shaft. The ribbon flange includes a cam face on the inner side than an outer circumference of the ribbon flange. A radial distance of the cam face from a center axis of the shaft varies in accordance with a rotation angle position of the ribbon flange. An upper end portion of the lock member restricts the rotation of the ribbon flange by contacting the cam face when the cover is open.

8 Claims, 15 Drawing Sheets

(56) References Cited

U.S. PATENT DOCUMENTS

| | | | | |
|---|---|---|---|---|
| 8,882,371 | B2 | 11/2014 | Chen | |
| 2015/0062278 | A1 | 3/2015 | Suzuki | |
| 2015/0165802 | A1* | 6/2015 | Wong | B41J 17/32<br>347/110 |
| 2015/0283834 | A1 | 10/2015 | Ohta | |

FOREIGN PATENT DOCUMENTS

| | | | |
|---|---|---|---|
| JP | 2013-014078 | A | 1/2013 |
| JP | 2014-046606 | A | 3/2014 |
| JP | 2014104744 | A | 6/2014 |
| JP | 2015051516 | A | 3/2015 |

* cited by examiner

SECT .A-A

PRINTER

CROSS-REFERENCE TO RELATED APPLICATION

This application is based upon and claims the benefit of priority from Japanese Patent Application No. 2017-185767 filed on Sep. 27, 2017, the entire disclosure of which is incorporated herein by reference.

TECHNICAL FIELD

The present disclosure relates to a printer.

BACKGROUND ART

In a printer that prints letters, characters and the like by transferring ink on a paper using an ink ribbon, the ink ribbon is wound in a roll around a feeding shaft. The printer feeds the ink ribbon at the same speed as the paper by winding the ink ribbon around a winding shaft. The ink ribbon is easily slackened since the ink ribbon is very thin and soft. Therefore, the ink ribbon is constantly tensioned to be kept flat during printing.

The printer includes a motor for feeding the papers and a gear train connected to the winding shaft via a clutch mechanism. The rotation of the gear train via the motor winds the ink ribbon around the winding shaft. The clutch mechanism includes a torsion spring. The feeding shaft includes a clutch mechanism which also includes a torsion spring. The ink ribbon between the feeding shaft and the winding shaft is biased by the respective torsion springs in directions toward the feeding and winding shafts. Consequently, the ink ribbon is constantly tensioned to be kept flat.

A casing of the printer includes a casing body that houses papers and a lid or cover that is opened and closed relative to the casing body. In the printer configured to include the motor in the casing body and the ink ribbon in the cover, the gear train in the cover disengages from the motor in the casing body when the cover is opened for changing papers or the like. Accordingly, the winding shaft does not receive the braking force generated by stopping the motor. On the other hand, the feeding shaft receives the torque from the torsion spring to pull the ink ribbon in a direction toward the feeding shaft from the winding shaft. Consequently, the ink ribbon is unwound from the winding shaft and slackened.

When the cover is closed while the ink ribbon is slackened, the tension may not be appropriately applied to the ink ribbon in the next printing and accordingly, the ink ribbon or paper may be jammed. To avoid the above issue, a printer is proposed, which prevents the winding shaft from being rotated in the direction opposite to the winding direction when the cover is open (see Patent Literature I: U.S. Pat. No. 8,882,371 B2, for example).

The printer disclosed in Patent Literature I includes a plurality of gears which forms the gear train in the cover to drive the winding shaft and a restriction gear with teeth for preventing the reverse rotation. The restriction gear is arranged in the axial direction with a gear branched from one or more of the plurality of gears. The teeth of the restriction gear engage with a rotatable lever. When the user manually rotates the ink ribbon in the winding direction to eliminate the slack of the ink ribbon that is generated upon mounting the ink ribbon, the lever engages the teeth of the restriction gear in response to the opening of the cover. In this state, the rotation of the restriction gear in the winding direction is allowed since the lever is pushed by the rotating teeth away from the teeth. On the other hand, the rotation of the restriction gear in the opposite direction is prevented since the lever engages the teeth of the restriction gear to restrict the rotation of the restriction gear.

SUMMARY

Generally, the ink ribbon and the ink ribbon flange are provided inside the casing body on the inner side in the width direction of the casing body. Accordingly, the gear train is provided inside the casing body on the outer side in the width direction thereof to avoid the ink ribbon, the ink ribbon flange and the like. Therefore, in the printer disclosed in Patent Literature I, the restriction gear is arranged with the gears of the gear train or the gears branched from the gear train in the axial direction at the outer side in the width direction of the casing body. Consequently, the size of the printer in the width direction increases. Moreover, the printer requires extra space for the rotation of the lever.

The present disclosure is made considering the above issue, and an object of the present disclosure is to provide a printer capable of suppressing an increase in the size in the width direction and preventing a winding shaft from rotating in a direction opposite to the winding direction without providing extra space.

A printer of the present disclosure includes a body, a cover configured to open and close relative to the body, a winding shaft provided in the cover for winding an ink ribbon, a regulation member provided in the cover and configured to change a position in accordance with an open and closed state of the cover, a passive member connected to an end of the winding shaft and configured to receive driving force, and a ribbon flange provided axially inside the passive member and configured to rotate with the winding shaft. The ribbon flange includes a cam face with a contour whose radial distance from an axis center of the winding shaft varies in accordance with a rotation angle position of the ribbon flange. The regulation member is configured to contact the cam face to restrict a rotation of the ribbon flange to one direction when the cover is open.

DESCRIPTION OF EMBODIMENTS

Hereinafter, embodiments of a printer according to the present disclosure will be described with reference to the drawings.

Figure 1:
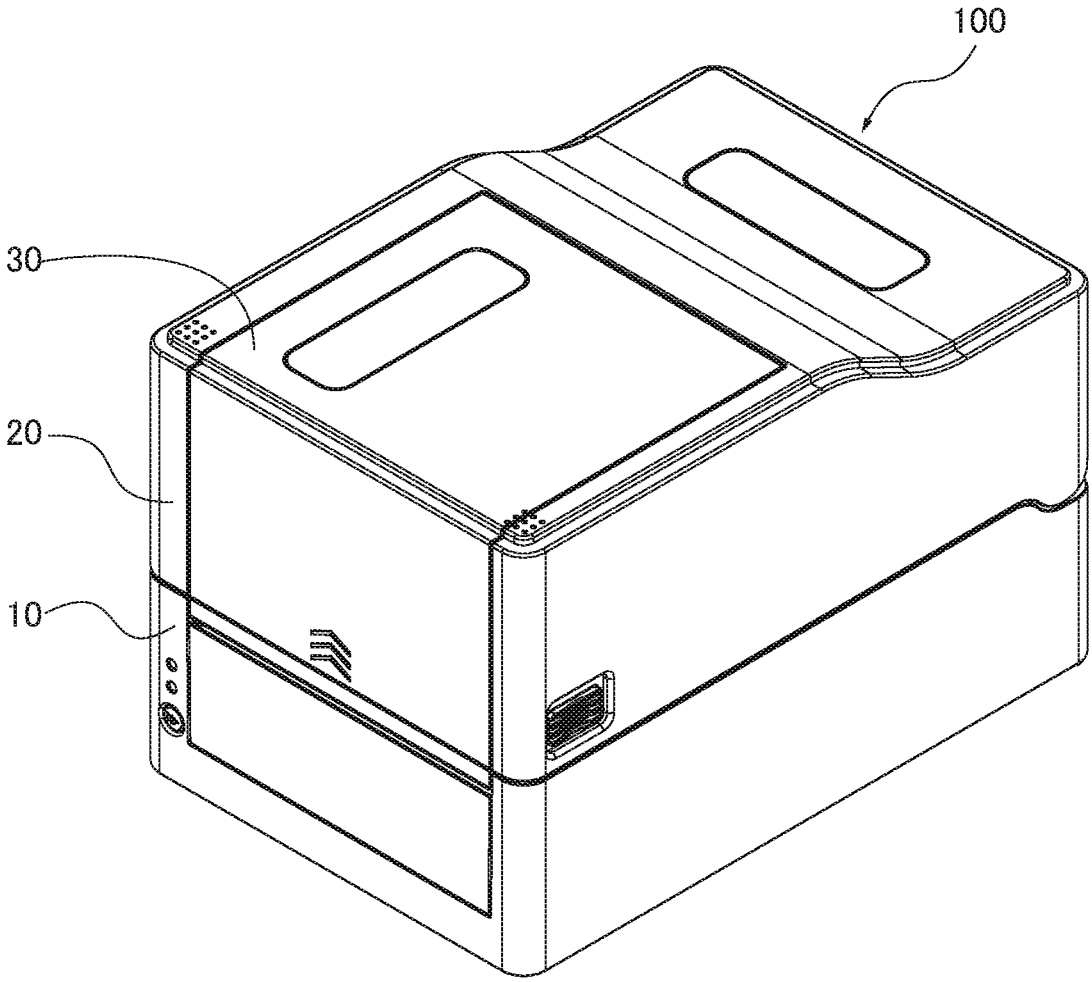
FIG. 1 is a perspective view illustrating a thermal printer (with a cover closed) which is an embodiment of a printer according to the present disclosure.
Figure 2:
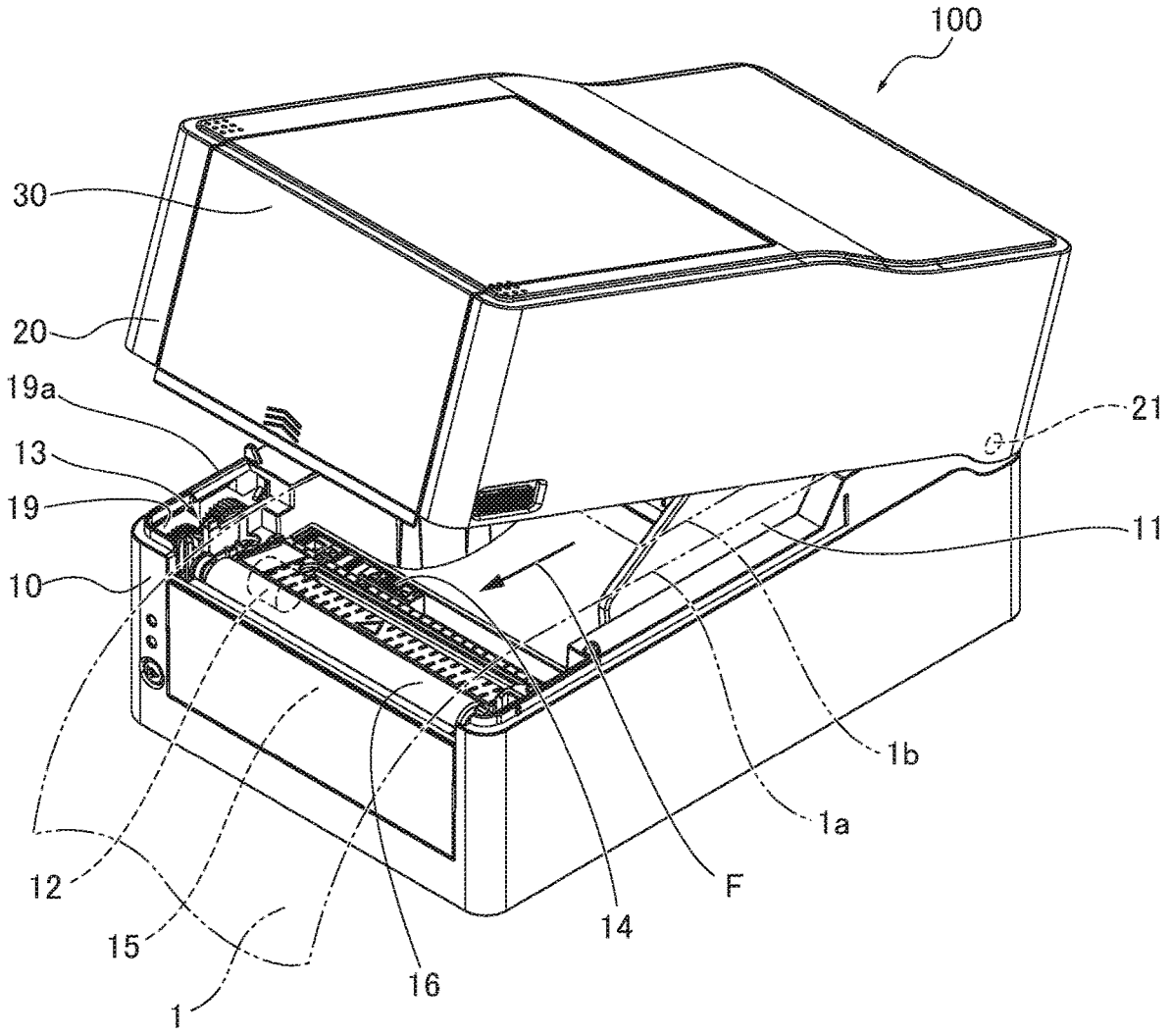
FIG. 2 is a perspective view illustrating the printer of FIG. 1 when the cover is open.
Figure 3:
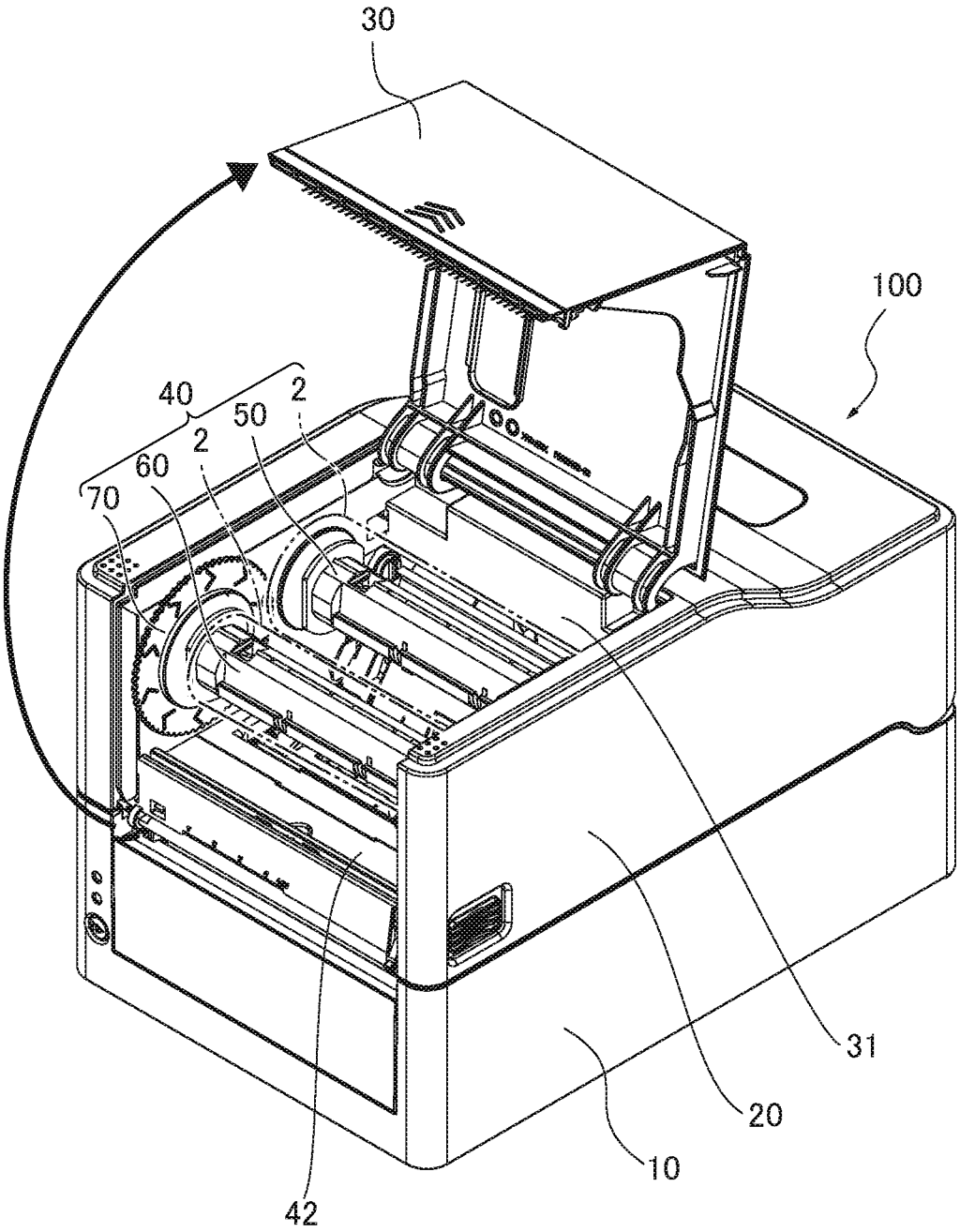
FIG. 3 is a perspective view illustrating the thermal printer shown in FIG. 1 when a top cover is open.

(Configuration of Thermal Printer) FIG. 1 is a perspective view illustrating a thermal printer 100 (referred to as the printer 100 hereinafter) in an embodiment of a printer according to the present disclosure. FIG. 2 is a perspective view illustrating the printer 100 when a lid or a cover 20 is open. FIG. 3 is a perspective view illustrating the printer 100 when a top cover 30 is open.

As shown in FIG. 1, the printer 100 includes a body 10 and a cover 20. The cover 20 is rotatably supported by the body 10. Specifically, a rear portion of the cover 20 in the vicinity of the bottom end of the cover 20 is supported by a rear portion of the body 10 in the vicinity of the upper end of the body 10. Therefore, the cover 20 rotates upward and rearward relative to the body 10 at a supported portion 21 as shown in FIG. 2.

The body 10 includes a paper storage portion 11. The paper storage portion 11 is exposed when the cover 20 is open. The paper storage portion 11 houses a label paper 1 in a roll, for example. In addition to the paper storage portion 11, the body 10 includes a motor 12, a gear train 13, a paper sensor 14, a control portion 15, a platen roller 16 and the like.

The motor 12 is driven under the control of the control portion 15 to rotate the gear train 13. The gear train 13 rotates the platen roller 16 to move the label paper 1 contacting the platen roller 16 forward F. When the cover 20 is closed, the gear train 13 engages with a gear train 90 in the cover 20 to rotate a winding shaft 60 of an ink ribbon 2 connected to the gear train 90.

The paper sensor 14 is configured to detect labels 1*b* on a paper mount 1*a* of the label paper 1. The control portion 15 is configured to control the motor 12 and a thermal print head 42 based on the detection result from the paper sensor 14 such that the printing to the labels 1*b* can be properly performed on the platen roller 16.

Figure 4:
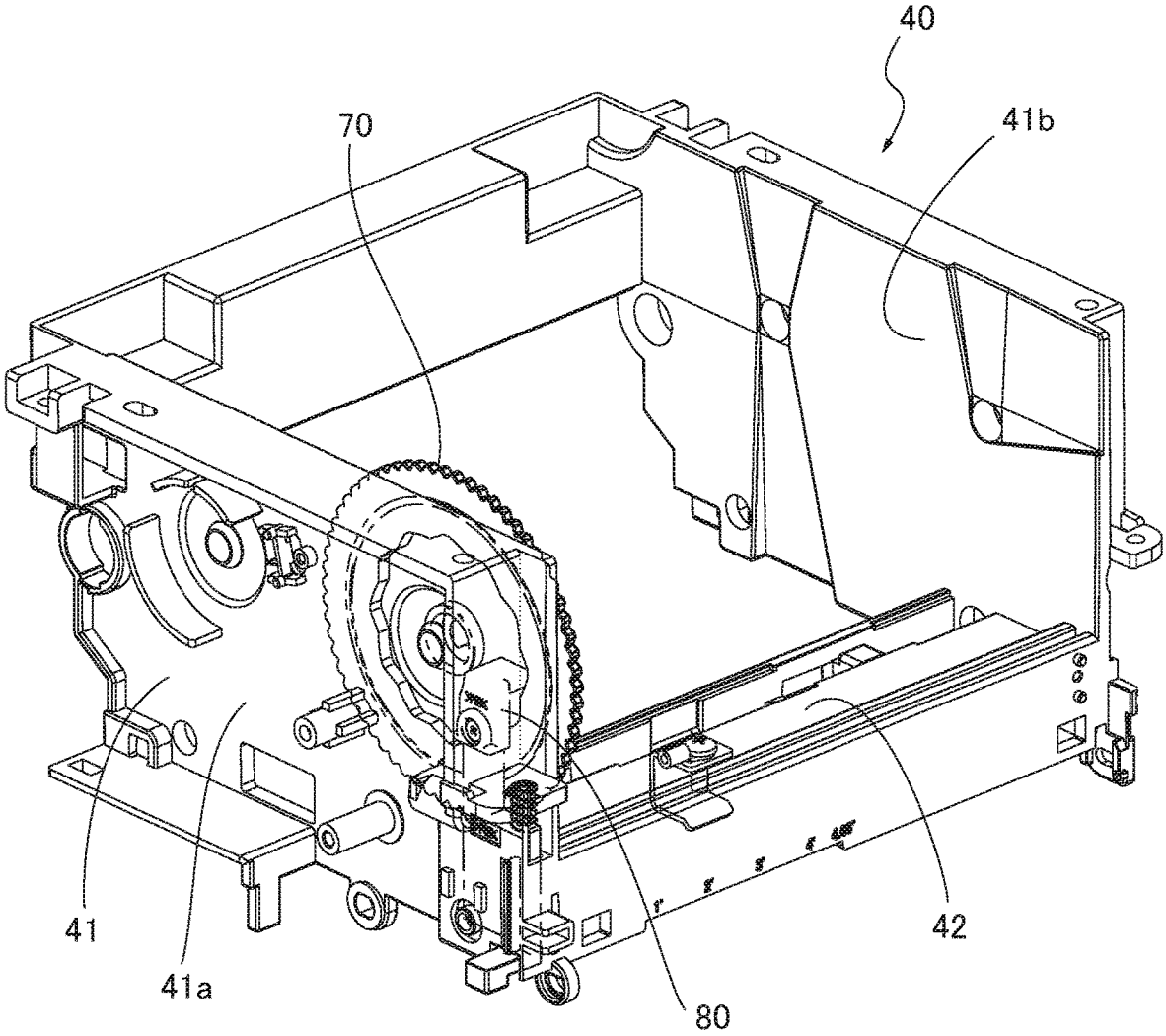
FIG. 4 is a perspective view illustrating a part of a printing portion.
Figure 5:
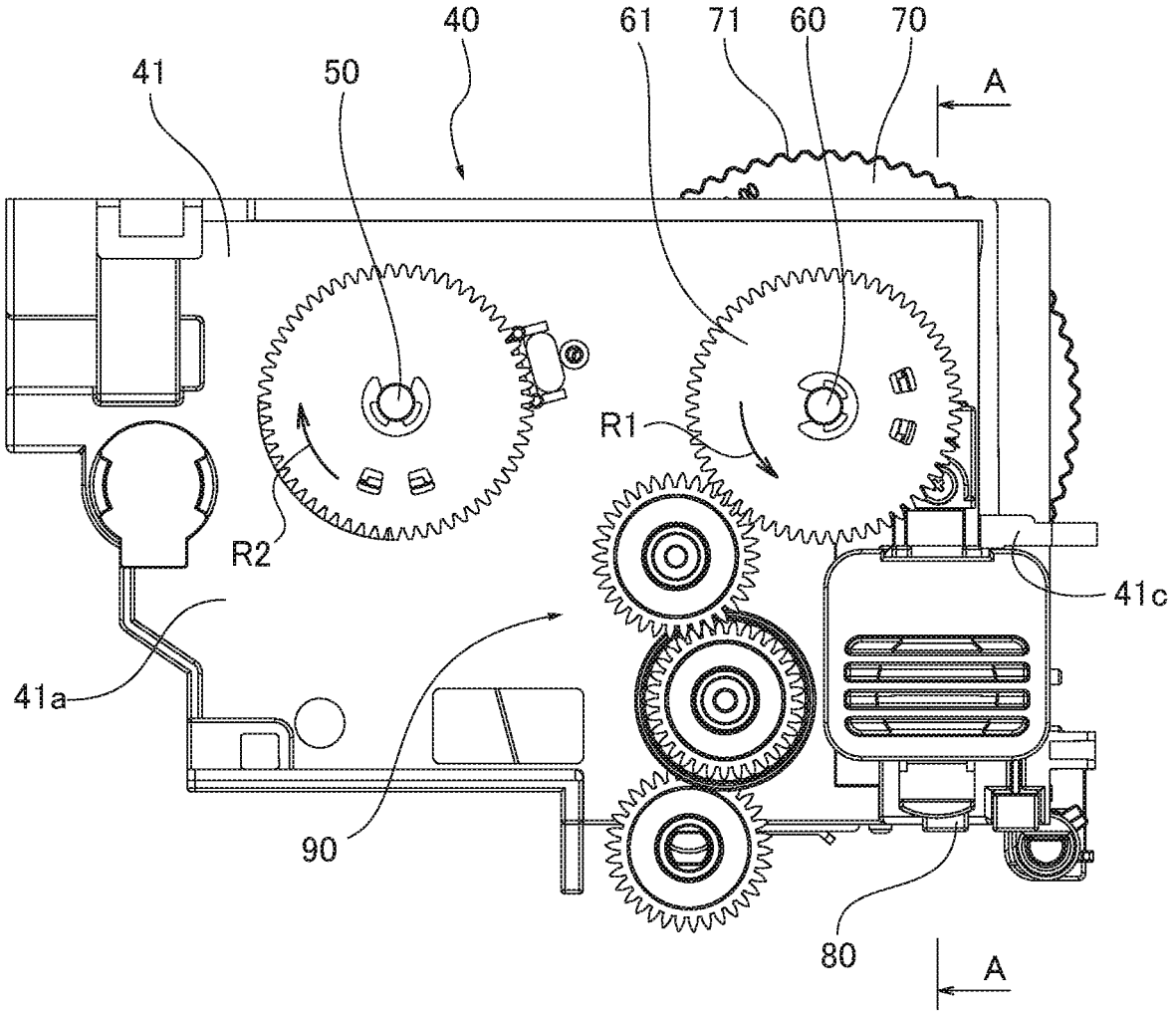
FIG. 5 is a side view illustrating one side of the printing portion.
Figure 6:
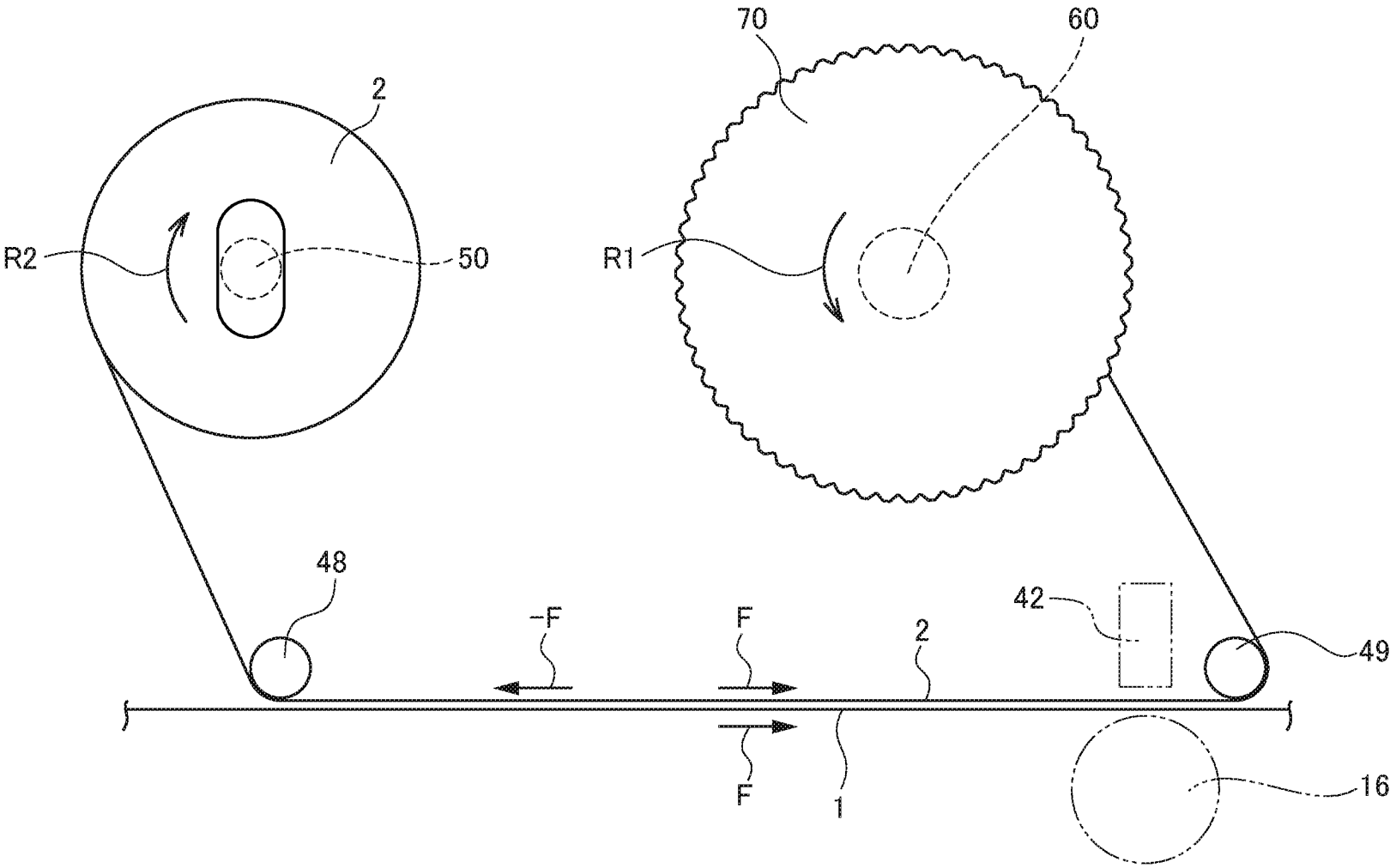
FIG. 6 is a schematic view illustrating an arrangement of an ink ribbon in the printing portion.
Figure 7:
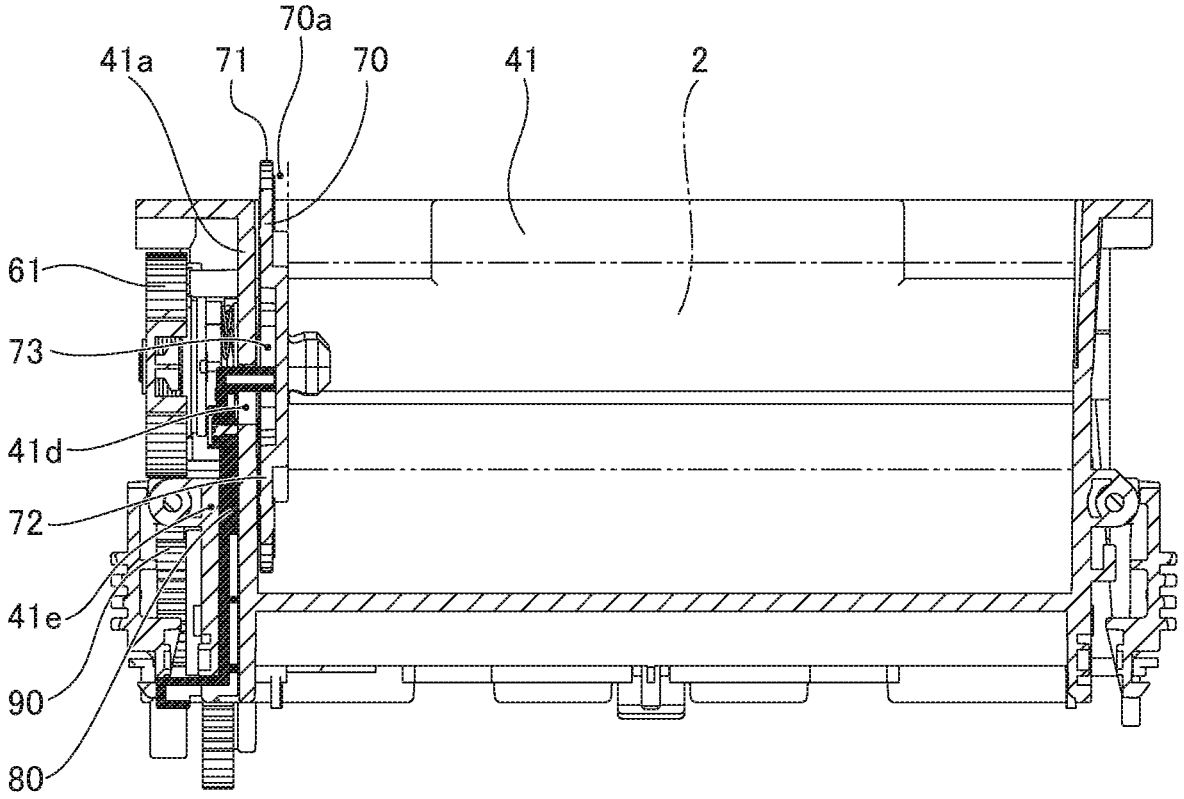
FIG. 7 is a cross-sectional view along a line A-A shown in FIG. 5.

As shown in FIG. 3, an ink ribbon storage portion 31 of the cover 20 houses a printing portion 40. FIG. 4 is a perspective view illustrating a part of the printing portion 40. FIG. 5 is a side view illustrating one side of the printing portion 40. FIG. 6 is a schematic view illustrating the arrangement of the ink ribbon 2 in the printing portion 40. FIG. 7 is a cross-sectional view along a line A-A shown in FIG. 5.

As shown in FIGS. 4 to 7, the printing portion 40 includes the ink ribbon 2, the thermal print head 42, a feeding shaft 50 for the ink ribbon 2, the winding shaft 60 for the ink ribbon 2, a ribbon flange 70, the gear train 90, a ribbon guide member 48 and a guide shaft 49 for guiding the ink ribbon 2, and a regulation member or lock member 80. These elements such as the thermal print head 42 are supported by a support member 41 which has a box shape.

As shown in FIG. 6, the thermal print head 42 is located above the platen roller 16 when the cover 20 is closed and controlled by the control portion 15. The unused portion of the ink ribbon 2 is wound in a roll around the feeding shaft 50 and the used portion of the ink ribbon 2 is wound in a roll around the winding shaft 60. In other words, the ink ribbon 2 is wound around the winding shaft 60 from the feeding shaft 50 in use. The ribbon guide member 48 and the guide shaft 49 are arranged on the path of the ink ribbon 2 between the feeding shaft 50 and the winding shaft 60 so that the thermal print head 42 and the platen roller 16 are located between the ribbon guide member 48 and the guide shaft 49 when the cover 20 is closed.

As shown in FIG. 6, the ink ribbon 2 is wound around the winding shaft 60 from the feeding shaft 50 via the ribbon guide member 48 and the guide shaft 49. In addition, the ink ribbon 2 overlaps the label paper 1 between the thermal print head 42 and the platen roller 16 and is moved forward F on the path between the ribbon guide member 48 and the guide shaft 49 at the same speed as the label paper 1 or a speed slightly faster than the label paper 1.

The feeding shaft 50 and the winding shaft 60 are disposed in the width direction between side walls 41*a*, 41*b* of the support member 41. The gear train 90 is disposed outside the side wall 41*a*. The winding shaft 60 extends through the side wall 41*a* and includes a winding gear 61 (passive member) at an end thereof. The gear train 90 engages with the winding gear 61 and rotates with the winding shaft 60. The gear train 90 also engages with the gear train 13 provided in the body 10 when the cover 20 is closed.

Accordingly, the winding shaft 60 is connected to the motor 12 when the cover 20 is closed but is disconnected from the motor 12 when the cover 20 is open. When the cover 20 is closed, the motor 12 rotates the winding shaft 60 in a direction for winding the ink ribbon 2 (i.e. the counterclockwise direction in FIG. 5; also referred to as the winding direction R1) via the gear train 13 in the body 10 and the gear train 90 in the cover 20 so that the ink ribbon 2 is wound around the winding shaft 60. When the motor 12 is stopped and the cover 20 is closed, the braking force of the motor 12 holds the winding shaft 60 unmoved.

On the other hand, when the cover 20 is open, the braking force of the motor 12 does not act on the winding shaft 60 since the winding shaft 60 is disconnected from the motor 12, but the rotation of the winding shaft 60 is restricted by the ribbon flange 70 and the lock member 80, which will be described below.

The feeding shaft 50 includes a torsion spring (not shown) that applies torque in a direction R2 opposite to the winding direction R1 (i.e. the clockwise direction R1) of the winding shaft 60 that winds up the ink ribbon 2. Accordingly, when the cover 20 is closed, the ink ribbon 2 receives a force that pulls the ribbon rearward, i.e. in a direction −F (minus F) by the torque of the torsion spring and a force that pulls the ribbon forward, i.e. in a direction F by the driving force of the motor 12. Therefore, the ink ribbon 2 is not slackened but tensioned to be kept flat.

Also, when the motor 12 is stopped, the ink ribbon 2 receives the force that pulls the ribbon rearward (i.e. in the direction −F) by the torque of the torsion spring and a force that keeps the ribbon in place by the braking force of the motor 12. Therefore, the ink ribbon 2 is not slackened but tensioned to be kept flat.

Accordingly, the portion of the ink ribbon 2 between the thermal print head 42 and the platen roller 16 is not slackened but pressed onto the label paper 1 when the cover 20 is closed and the printer is in use. Therefore, the ink of the ink ribbon 2 is appropriately transferred to the label paper 1 so that the printing is properly performed. Also, the ink ribbon 2 is not slackened when the cover 20 is closed and the printer is not in use. Accordingly, the printing can be resumed with the ink ribbon 2 which is not slackened at the next use.

As shown in FIG. 7, the winding shaft 60 includes a ribbon flange 70 which has a disc shape. The ribbon flange 70 is located at an inner side of the side wall 41*a* of the support member 41. The ribbon flange 70 is configured to prevent the ink ribbon 2 wound around the shaft 60 from moving in one of the axial directions along the shaft 60. Also, the ribbon flange 70 is configured to allow the winding shaft 60 to be manually rotated, which will be described below. The ribbon flange 70 may also be provided to prevent the ink ribbon 2 wound around the shaft 60 from moving in the axial direction along the shaft 60 by the side edge of the ink ribbon 2 contacting the ribbon flange 70.

Figure 8:
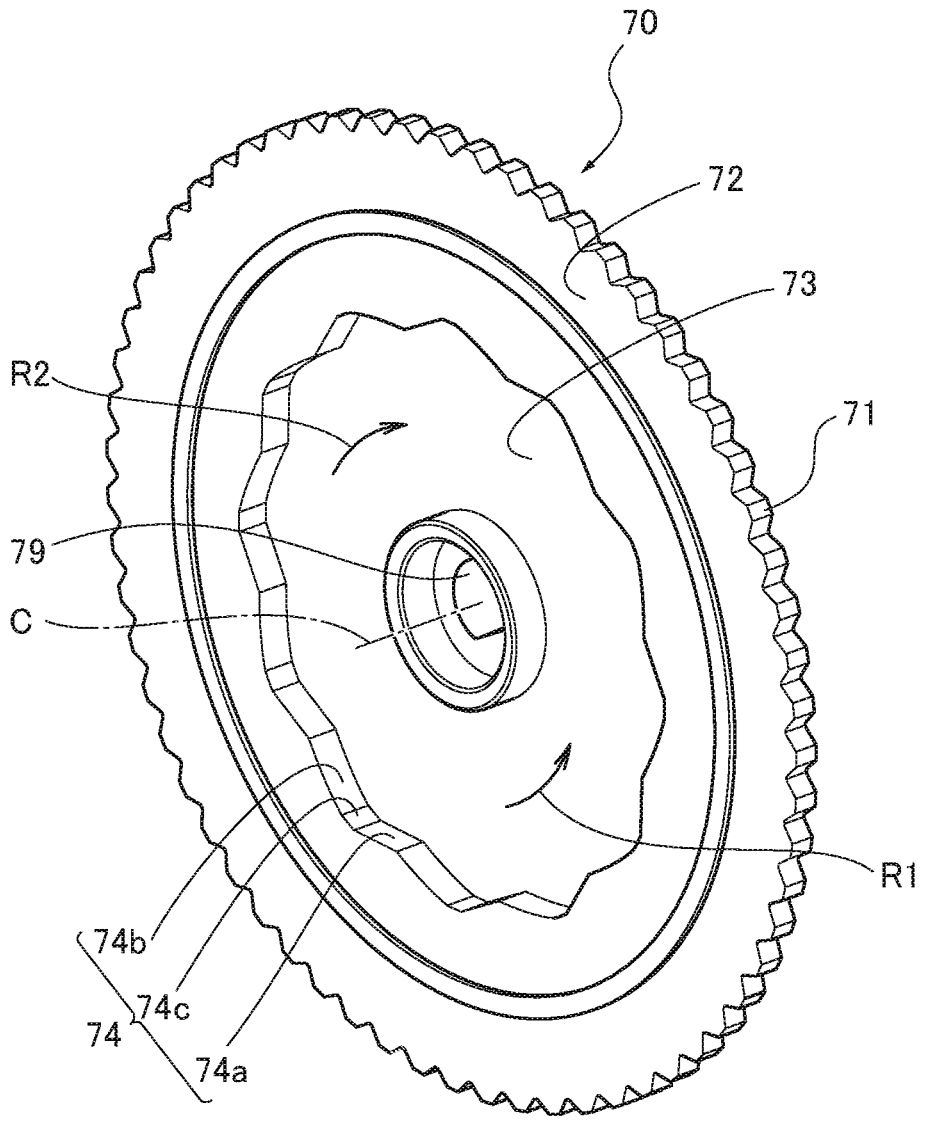
FIG. 8 is a perspective view illustrating a ribbon flange.

FIG. 8 is a perspective view illustrating the ribbon flange 70. As shown in FIG. 8, the ribbon flange 70 includes a through-hole 79 in the center thereof. The through-hole 79 has a substantially D-shaped cross-section. Corresponding to the through-hole 79, the winding shaft 60 also has a substantially D-shaped cross-section. The winding shaft 60 is fitted into the through-hole 79 so that the ribbon flange 70 rotates integrally with the shaft 60. The substantially D-shaped cross-sections of the through-hole 79 and the winding shaft 60 prevent the winding shaft 60 to freely rotate in the through-hole 79. The ribbon flange 70 includes teeth 71 on an outer circumference. The teeth 71 provide an anti-slip function when the user manually rotates the ribbon flange 70 about the axis of the shaft 60 by putting her or his fingers on the teeth 71.

The ribbon flange 70 includes a surface 72 facing the side wall 41*a* and a surface facing the ink ribbon 2. A recess 73 is provided on the surface 72 at an area radially inward from the outer circumference of the ribbon flange 70. The recess 73 is concaved in the thickness direction of the ribbon flange 70. The recess 73 includes a plurality of cam faces 74 on the circumference thereof. The cam faces 74 may consist of twelve faces continuously formed on the entire circumference of the recess 73, for example. The cam faces 74 have radial distances from the center of the shaft 60 that vary in accordance with the rotation angle about the shaft 60 fitted in the through-hole 79. The cam faces 74 are configured to regulate or restrict the rotation of the ribbon flange 70 by contacting the lock member 80, which will be described below.

As shown in FIG. 8, each of the cam faces 74 includes a first cam face 74*a*, a second cam face 74*b*, and a third cam face 74*c*. The first cam face 74*a* is a flat surface. The second cam face 74*b* is a curved surface that protrudes radially outwardly. The third cam face 74*c* connects the first cam face 74*a* and the second cam face 74*b*. The third cam face 74*c* is a short arc surface or a flat surface where the radius or radial distance from the center axis C is the largest and is substantially constant. The first cam face 74*a*, the third cam face 74*c*, and the second cam face 74*b* are arranged in a clockwise direction R2 in this order as shown in the figures.

Figure 9:
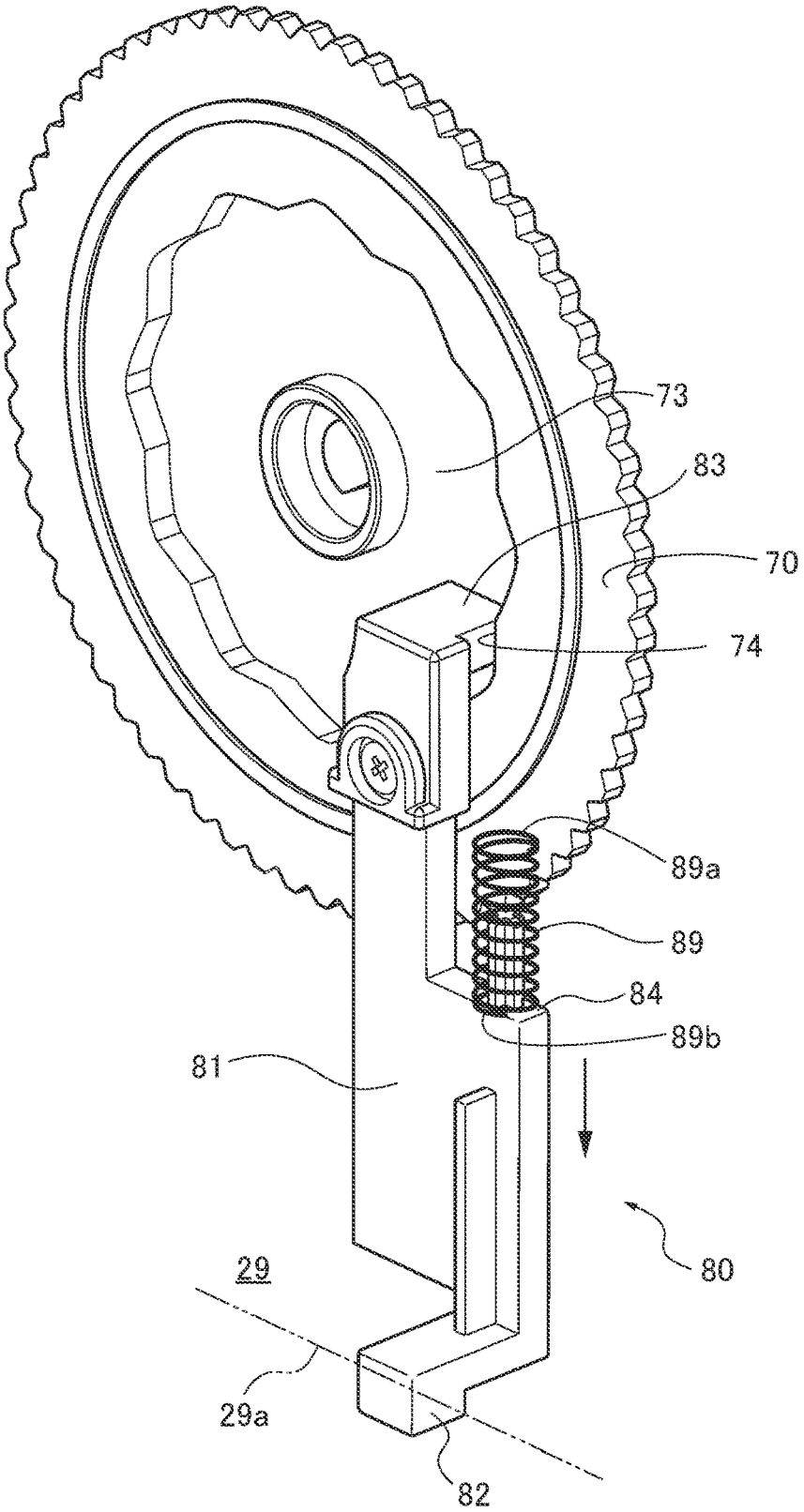
FIG. 9 is a perspective view illustrating a lock member moved to a bottom end of a movable range.
Figure 10:
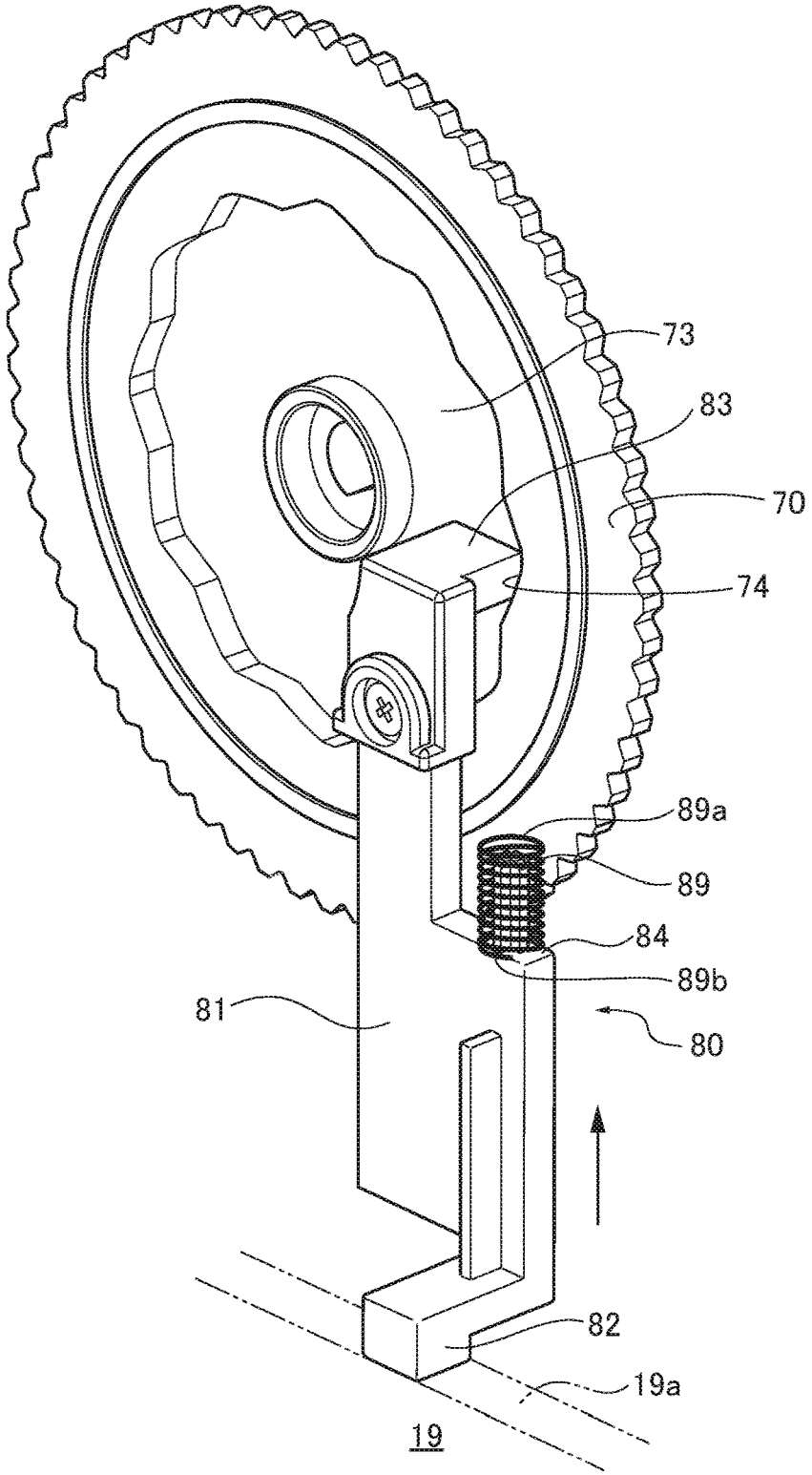
FIG. 10 is a perspective view illustrating the lock member moved upward from the bottom end of the movable range.

FIG. 9 is a perspective view illustrating the lock member 80 moved to the bottom end of the movable range. FIG. 10 is a perspective view illustrating the lock member 80 moved upward from the bottom end of the movable range. As shown in FIG. 7, the lock member 80 is provided outside the side wall 41*a* of the support member 41. As shown in FIG. 9, the lock member 80 includes a movable portion 81 and a coil spring 89. The movable portion 81 is a main body of the lock member 80 and configured to regulate the rotation of the ribbon flange 70.

As shown in FIG. 7, the side wall 41*a* includes a guide portion 41*e* integrally formed therewith. The guide portion 41*e* is disposed so that the movable portion 81 is located between the guide portion 41*e* and the side wall 41*a*. The guide portion 41*e* is configured to guide the movable portion 81 so that the movable portion 81 only moves within a predetermined range. Specifically, the guide portion 41*e* restricts the moving direction of the movable portion 81 to the vertical direction in the figure (the opening and closing direction of the cover 20 (tangent direction of the opening and closing direction when opening)) and the moving range of the movable portion 81 to the predetermined range. Alternatively, the side wall 41*a* may include an elongate hole extending in the vertical direction instead of the guide portion 41*e* and the movable portion 81 may include a convex portion. In this case, the convex portion may be inserted into the elongate hole and moved upward and downward to guide the movable portion 81. Such configuration does not require the guide portion 41*e*.

The movable portion 81 extends in the vertical direction and includes an upper end portion 83, an intermediate portion, and a bottom end portion 82. The upper end portion 83 is bent inward in the width direction of the support member 41 and extends through an opening 41*d* on the side wall 41*a* into the recess 73 of the ribbon flange 70. The bottom end portion 82 is bent outward in the width direction of the support member 41 and contacts the upper surface 19*a* of the side wall 19 of the body 10 (see FIG. 2) from above when the cover 20 is closed. Further, the movable portion 81 includes a spring seat 84 at the intermediate portion. The spring seat 84 receives the coil spring 89 and contacts a bottom end 89*b* of the coil spring 89.

Thought the bottom end portion 82 is an outermost portion projecting in the width direction of the printing portion 40 among the movable portion 81 and the coil spring 89, the bottom end portion 82 is located inside the gear train 90 and the winding gear 61 in the width direction as shown in FIG. 7.

A spring receiving portion 41*c* (see FIG. 5) is disposed outside the side wall 41*a* of the support member 41 which is provided in the cover 20. The spring receiving portion 41*c* (see FIG. 5) receives the coil spring 89 and contacts the upper end 89*a* of the coil spring 89. The coil spring 89 is arranged between the spring seat 84 and the spring receiving portion 41*c* with contracted from its natural length. As a result, an elastic force acts between the movable portion 81 and the side wall 41*a* for restoring the coil spring 89 from the contracted state to the natural length. The elastic force pushes down the movable portion 81 to the bottom end of a movable range in the vertical direction.

The bottom end portion 82 of the movable portion 81 extends below the bottom surface 29*a* of the side wall 29 in the cover 20 at the bottom end of the movable range. However, the bottom surface 29*a* of the cover 20 contacts the upper surface 19*a* of the side wall 19 of the body 10 when the cover 20 is closed. Accordingly, when the cover 20 is closed, a bottom surface of the bottom end portion 82 contacts the upper surface 19*a* of the side wall 19 of the body 10 as shown in FIG. 10 so that the movable portion 81 is pushed up to the upper end of the movable range against the elastic force of the coil spring 89. The movable portion 81 is an example of the regulation member whose position changes in accordance with the open and closed state of the cover 20.

Figure 11:
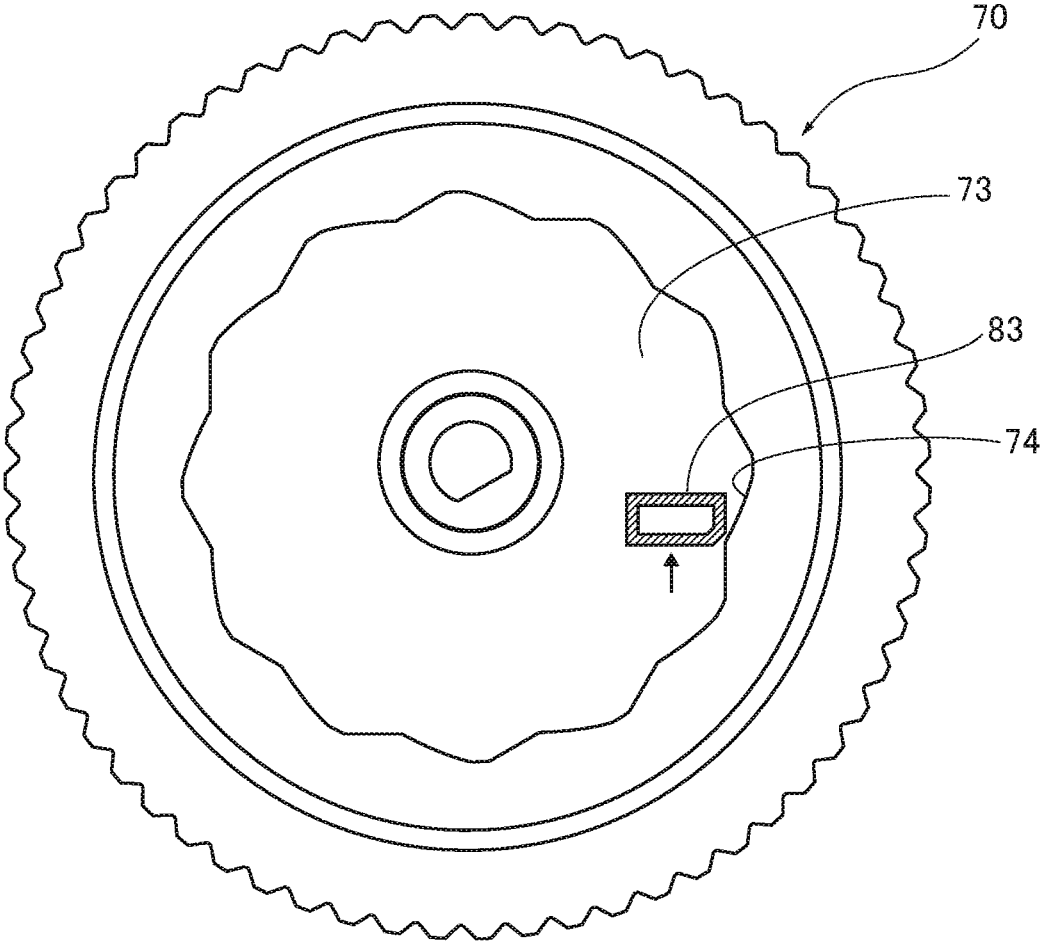
FIG. 11 is a side view illustrating a positional relation between a cam face and an upper end portion shown in FIG. 10.
Figure 12:
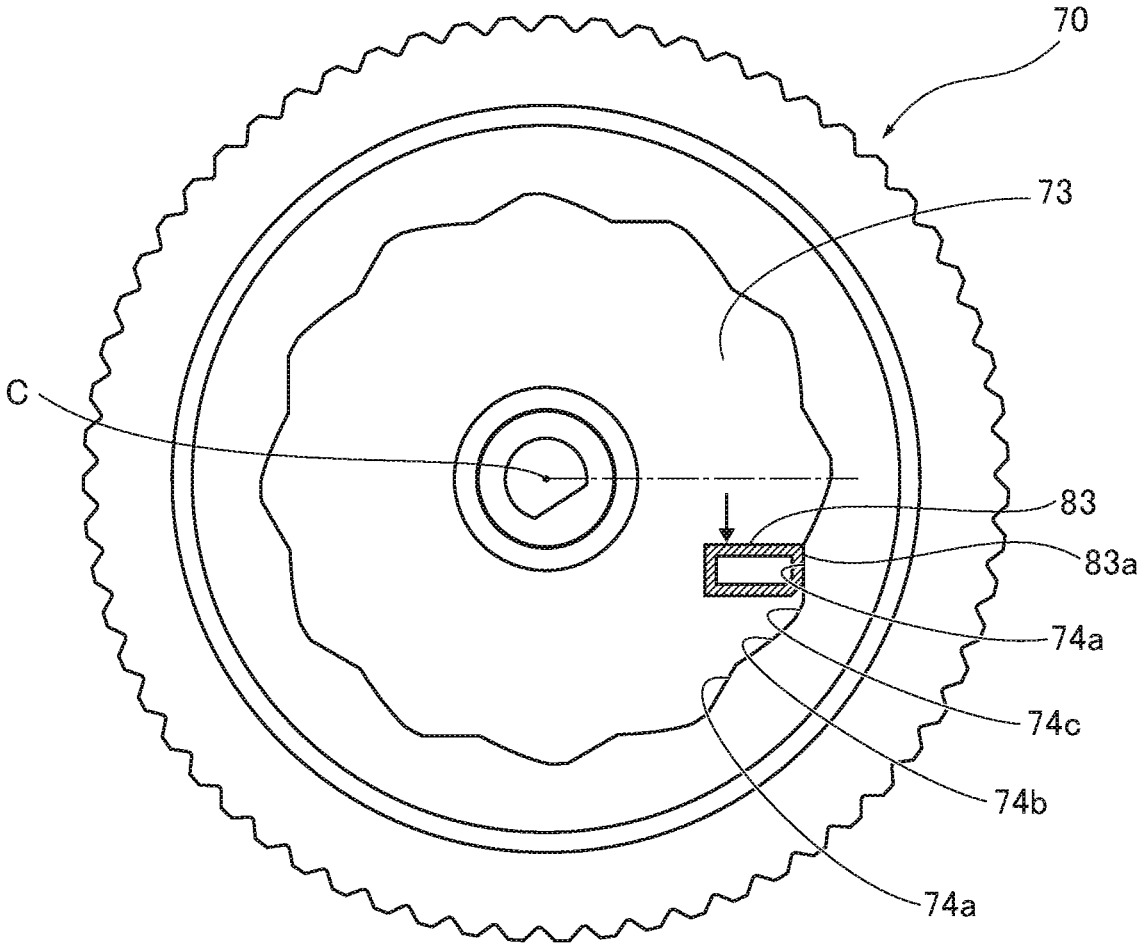
FIG. 12 is a side view illustrating the positional relation between the cam face and the upper end portion shown in FIG. 9.

FIG. 11 is a side view illustrating a positional relation between the cam face 74 and the upper end portion 83 shown in FIG. 10. FIG. 12 is a side view illustrating the positional relation between the cam face 74 and the upper end portion 83 shown in FIG. 9. When the cover 20 is closed, the movable portion 81 is moved to the upper end of the movable range and the upper end portion 83 extending into the recess 73 of the ribbon flange 70 escapes to a position where the upper end portion 83 does not contact the cam face 74 which is the circumferential surface of the recess 73.

Specifically, as shown in FIG. 11, the upper end portion 83 of the movable portion 81 that has been moved upward is located radially inward of the cam faces 74 of the ribbon flange 70 so that the upper end portion 83 does not contact the cam faces 74 when the ribbon flange 70 rotates. Therefore, the movable portion 81 does not prevent the rotation of the winding shaft 60 when the cover 20 is closed.

On the other hand, the movable portion 81 is moved to the bottom end of the movable range when the cover 20 is open, and the upper end portion 83 extending into the recess 73 of the ribbon flange 70 contacts the cam face 74 of the ribbon flange 70 as shown in FIG. 12. As shown in FIGS. 11 and 12, the upper end portion 83 extending into the recess 73 is substantially rectangular in a cross-section and a lower right corner in the figure is chamfered. The upper end portion 83 is positioned lower than the center axis C of the ribbon flange 70 in the state where the movable portion 81 has been moved to the bottom end of the movable range. In this state, a right side surface 83*a* of the upper end portion 83 contacts the first cam face 74*a*, which is in a vertically extending state.

Figure 13:
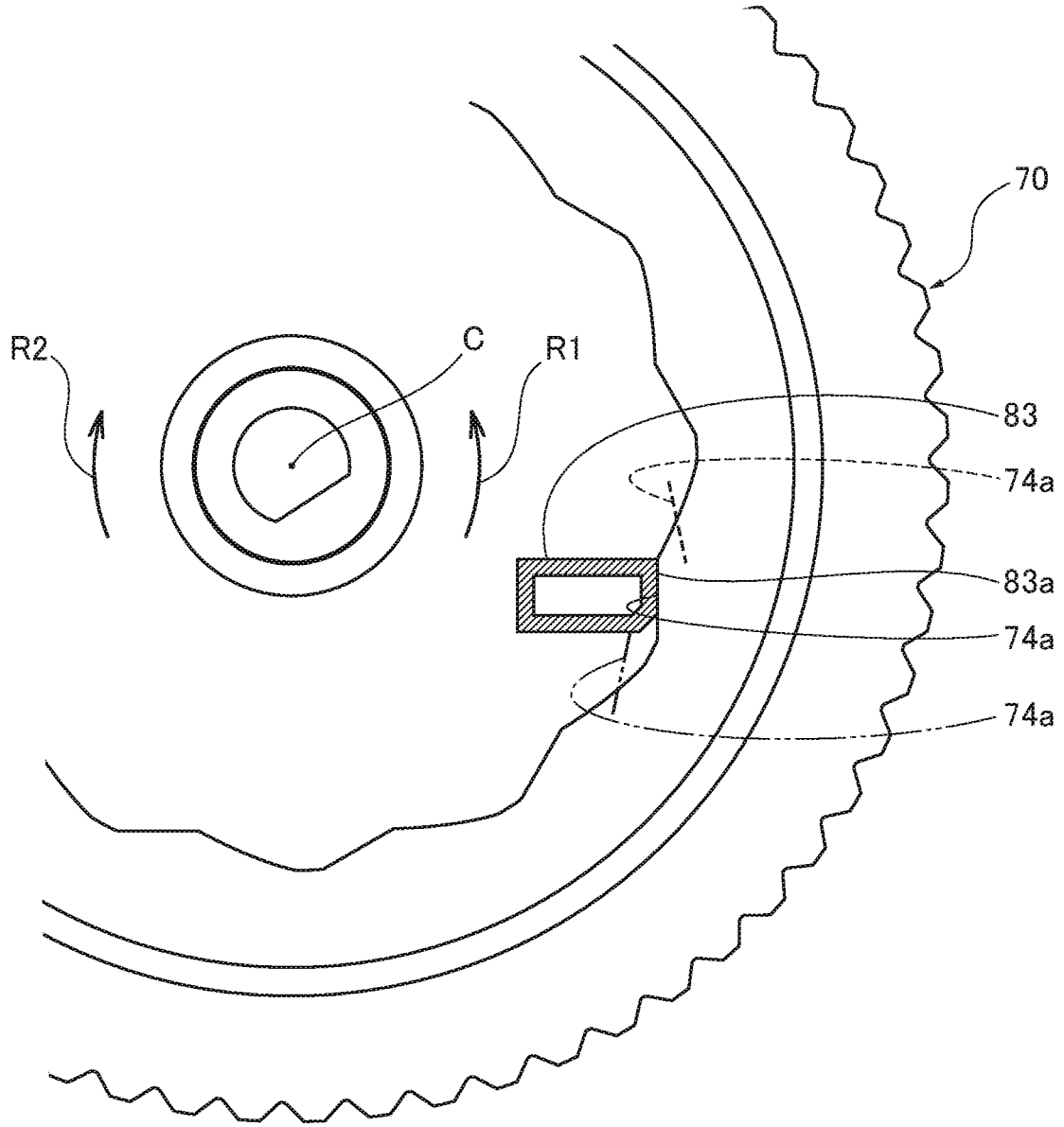
FIG. 13 is an enlarged view illustrating the positional relation between the cam face and the upper end portion shown in FIG. 12 and the movement of a first cam face.

FIG. 13 shows an enlarged view illustrating the positional relation between the cam face 74 and the upper end portion 83 shown in FIG. 12 and the movement of the first cam face 74*a*. Now, the movement from the state where the right side surface 83*a* of the upper end portion 83 contacts the first cam face 74*a* of the ribbon flange 70 is described. When the ribbon flange 70 rotates in the clockwise direction R2 (i.e. the unwinding direction) opposite to the winding direction R1 relative to the ink ribbon 2, the first cam face 74*a* located lower than the center axis C moves downward and leftward in the figure to a position shown with a two-dot chain line in FIG. 13.

The bottom portion of the first cam face 74*a* has a radius from the center axis C larger than that of the upper portion of the first cam face 74*a*. Accordingly, when the first cam face 74*a* reaches a position where the first cam face 74*a* is aligned horizontally with the center axis C by the rotation in the winding direction R1, the first cam face 74*a* is inclined to extend diagonally up left so that the bottom portion is horizontally further away from the center axis C than the upper portion.

Specifically, when the ribbon flange 70 rotates in the clockwise direction R2, the first cam face 74*a* moves into a space occupied by the upper end portion 83 the first cam face 74*a* contacts before the rotation. Therefore, in a condition to rotate the ribbon flange 70 in the clockwise direction R2, the first cam face 74*a* contacting the flat right side surface 83*a* of the upper end portion 83 must push the upper end portion 83 to move the upper end portion 83 upward or leftward.

However, the movable portion 81 including the upper end portion 83 does not move in the horizontal direction but only in the vertical direction. Moreover, the movable portion 81 including the upper end portion 83 is in a state that the right side surface 83*a* contacts the first cam face 74*a*. Accordingly, the upper end portion 83 cannot be moved upward even if the first cam face 74*a* intended to rotate in the clockwise direction R2 pushes the right side surface 83*a*. Consequently, the lock member 80 restricts the movement of the ribbon flange 70 and prevents the ribbon flange 70 from moving in the clockwise direction R2. Therefore, the rotation of the winding shaft 60 in the direction to unwind the ink ribbon 2 (i.e. the clockwise direction R2) and accordingly the slack of the ink ribbon 2 can be prevented even if the braking force of the motor 12 is not applied to the winding shaft 60 while the cover 20 is opened.

On the other hand, when the ribbon flange 70 rotates in the counterclockwise direction R1 (i.e. the direction for winding the ink ribbon 2), the first cam face 74*a* located lower than the center axis C moves upward and rightward to a position shown with a dashed line as shown in FIG. 13.

Specifically, when the ribbon flange 70 rotates in the counterclockwise direction R1, the first cam face 74*a* moves away from the upper end portion 83 which the first cam face 74*a* contacts before the rotation, and the upper end portion 83 of the movable portion 81 does not restrict the rotation of the ribbon flange 70 in relation to the first cam face 74*a*.

Figure 14:
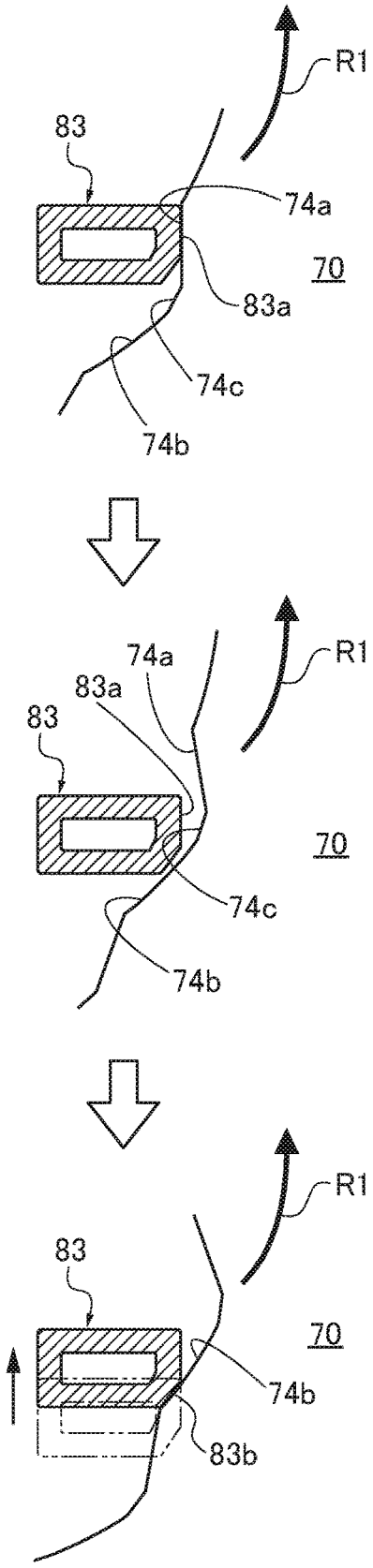
FIG. 14 is a schematic view illustrating the transition of the positional relation among the first cam face, a second cam face and the upper end portion when the ribbon flange rotates in a counterclockwise direction R1.

FIG. 14 is a schematic view illustrating the transition of the positional relation among the first the cam face 74*a*, the second the cam face 74*b* and the upper end portion 83 when the ribbon flange 70 rotates in the counterclockwise direction R1. As shown in the top and middle views of FIG. 14, when the ribbon flange 70 rotates in the counterclockwise direction R1, the first cam face 74*a* moves away from the right side surface 83*a* of the upper end portion 83 while the third cam face 74*c* next to the first cam face 74*a* and the second cam face 74*b* next to the third cam face 74*c* approach the upper end portion 83 from the lower and left sides of the upper end portion 83.

As the rotation of the ribbon flange 70 in the counterclockwise direction R1 progresses, the third cam face 74*c* does not contact the upper end portion 83 while the second cam face 74*b* approaches to contact a chamfered surface or C surface 83*b* of the upper end portion 83 from the lower and left sides as shown in the middle view of FIG. 14. The C surface 83*b* is formed at an end of the right side surface 83*a* of the upper end portion 83 in the clockwise direction R2 (i.e. the rotational direction restricted by the lock member 80).

Then, the rotation of the ribbon flange 70 progresses with the second cam face 74*b* contacting the C surface 83*b*. At this time, the second cam face 74*b* applies upward and rightward loads to the C surface 83*b*. The rightward load does not move the upper end portion 83 rightward since the second cam face 74*b* and the C surface 83*b* slide relative to each other. The lower right corner of the upper end portion 83 is not a sharp corner but has the chamfered C surface 83*b*, and the second cam face 74*b* is formed of a curved surface that protrudes outward with respect to the upper end portion 83. Accordingly, the relative contact angle between the C surface 83*b* and the second cam face 74*b* becomes shallow, so that the slide between the C surface 83*b* and the second cam face 74*b* occurs easily.

It should be noted that changing the contour shape of the second cam face 74*b* makes it easier for the rightward load to be released by sliding without forming the C surface 83*b* on the upper end portion 83. Also, forming the upper end portion 83 to have a shape that easily causes rightward sliding makes it easier for the rightward load to be released by sliding even if the upper end portion 83 is not formed substantially rectangular as described above.

The upward load on the upper end portion 83 is released by moving the movable portion 81 (the upper end portion 83) upward against the elastic force for compressing the coil spring 89 as shown in the bottom view of FIG. 14. Before the movable portion 81 reaches the upper end of the movable range, the second cam face 74*b* moves away from the upper end portion 83, the movable portion 81 moves to the bottom end of the movable range by the elastic force of the coil spring 89, and the upper end portion 83 returns to a position where the right side surface 83*a* contacts the first cam face 74*a* as shown in the top view of FIG. 14.

It should be noted that the two-dot chain lines in the bottom view of FIG. 14 show a position of the upper end portion 83 when the movable portion 81 (the upper end portion 83) does not move upward.

As described above, the lock member 80 allows the rotation of the ribbon flange 70 in the counterclockwise direction R1. Accordingly, a user can manually rotate the ribbon flange 70 in the counterclockwise direction R1 with his or her fingers on the teeth 71 of the ribbon flange 70 when cover 20 is open and the braking force of the motor 12 does not act on to the winding shaft 60. Consequently, in the printer 100 of the present embodiment, the slack of the ink ribbon 2 can be manually removed when the ink ribbon 2 is slackened or the ink ribbon 2 gets slackened upon replacing the ink ribbon 2.

According to the present embodiment, the printer 100 can suppress an increase in the size of the printer 100 in the width direction of the ink ribbon 2 and prevent the winding shaft from rotating in the direction R2 opposite to the winding direction without providing extra space for the lock member 80 since the printer 100 is configured such that the lock member 80 extends into the recess 73 of the ribbon flange 70 but is not arranged with the gear train 90 or the winding gear 61 in the axial direction thereof.

Further, a part of the upper end portion 83 in the lock member 80 extends into the recess 73 of the ribbon flange 70 and remains within the recess 73. Accordingly, the position of the lock member 80 can be moved toward the ribbon flange 70 by the substantially same distance as the depth of the recess 73, which makes it easier to suppress the printer 100 from increasing in size in the width direction of the ink ribbon 2.

The ribbon may reach close to the tips of the teeth 71 of the ribbon flange 70 when the diameter of the used ink ribbon 2 wound around the winding shaft 60 becomes as thick as the diameter of the ribbon flange 70. Consequently, it may be difficult for the user to put his or her fingers on the teeth 71 of the ribbon flange 70 when the user manually rotates the ribbon flange 70. However, in the printer 100 of the present embodiment, the inner surface of the ribbon flange 70 includes a separating portion 70*a* at the radially outer area as shown in FIG. 7. The separating portion 70*a* is concaved to be further away from the ink ribbon 2 compared to a radially inner area so that space is formed between the ink ribbon 2 and the teeth 71. The separating portion 70*a* makes it easier for the user to put his or her fingers on the teeth 71 of the ribbon flange 70.

Moreover, the separating portion 70*a* is formed at the radially outer area than the recess 73 as shown in the figures such as FIG. 8. Accordingly, the recess 73 can be formed to have a depth where the cam faces 74 are formed regardless of the thickness of the separating portion 70*a* in the ribbon flange 70.

The separating portion 70*a* is continuously formed in the radially outer area over the entire circumference of the ribbon flange 70 as shown in FIG. 7. However, the separating portion 70*a* may be partially formed in the radially outer area. For example, a plurality of separating portions 70*a* may be formed in the radially outer area to be spaced apart from each other.

In the printer 100 according to the present embodiment, the position of the cam face 74 the lock member 80 contacts is located lower than the center axis C of the ribbon flange 70 as shown in FIGS. 11 and 12. However, in the printer according to the present disclosure, the location where the regulation member and the cam face contact each other to restrict the rotation of the ribbon flange is not limited to the location in the printer 100 of the present embodiment.

Figure 15:
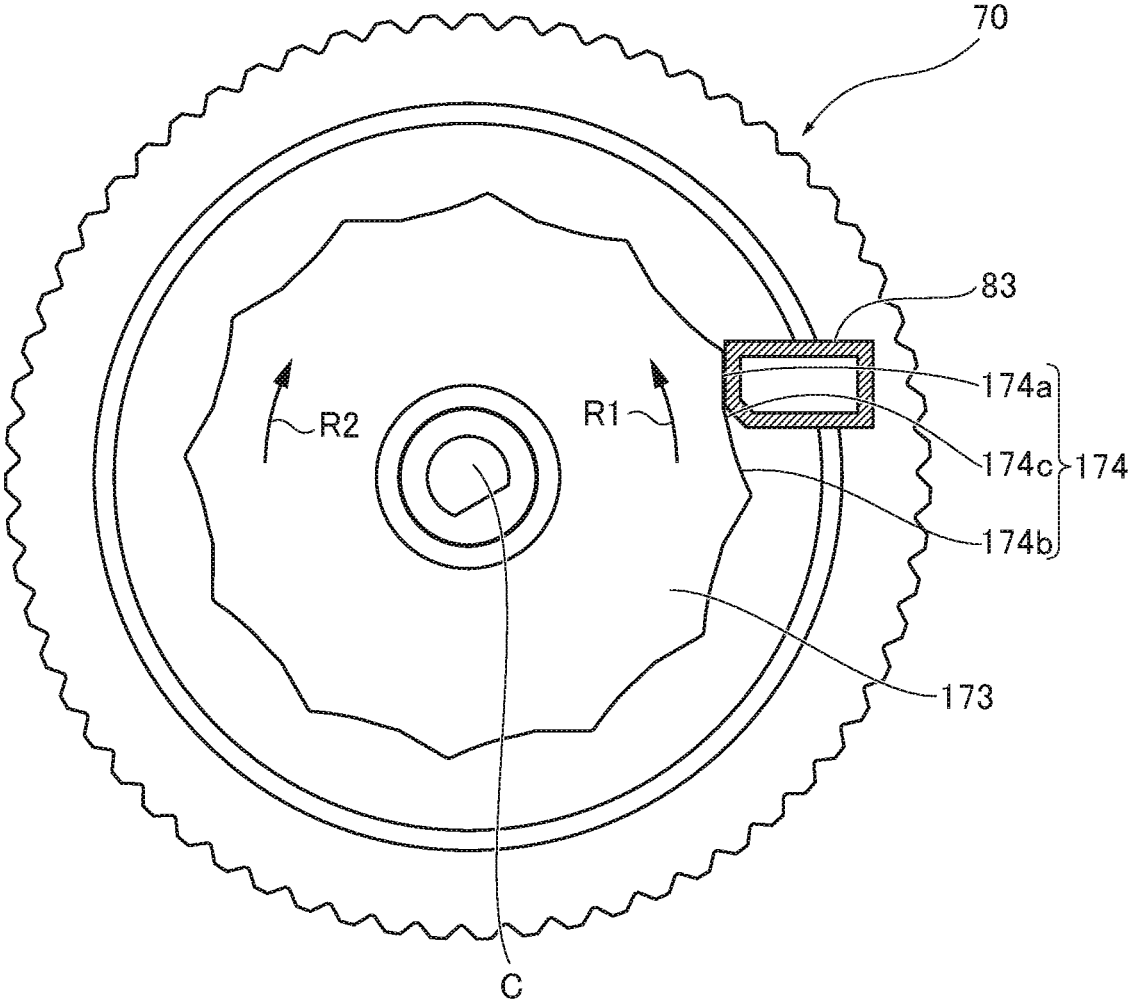
FIG. 15 is a schematic view corresponding to FIG. 12 and illustrating a ribbon flange and an upper end portion of a movable portion in a modified embodiment.

(Modification) FIG. 15 is a schematic view corresponding to FIG. 12 and illustrating a modification of the ribbon flange 70 and the upper end portion 83 of the movable portion 81. In the printer 100 of the above embodiment, the recess 73 is formed on the surface 72 of the ribbon flange 70 and the cam faces 74 are formed on the inner circumference of the recess 73. However, as shown in FIG. 15, a convex portion 173 may be provided to extend from the surface of the ribbon flange 70 and cam faces 174 may be formed on the outer circumference of the convex portion 173.

In this case, it is necessary to modify the cross-section profile of the upper end portion 83 of the movable portion 81 in accordance with the cam faces 174. The cam face 174 and the upper end portion 83 contact each other at a position higher than the center axis C of the ribbon flange 70 as shown in the figure. The cam face 174 includes a first cam face 174*a*, a second cam face 174*b*, and a third cam face 174*c*. Preferably, the first cam face 174*a* is a flat surface and the second cam face 174*b* is a curved surface that is concave radially inwardly. Preferably, the third cam face 174*c* which connects the first cam face 174*a* and the second cam face 174*b* is a flat surface or a curved surface that is concave radially inwardly.

In the printer 100 of the present embodiment and the modification, the cam faces 74 or 174 which restrict the rotation of the ribbon flange 70 in the clockwise direction R2 by the lock member 80 are provided in the ribbon flange 70 between the side walls 41*a*, 41*b* of the printing portion 40. Accordingly, the amount of the protrusion of the lock member 80 in the width direction can be suppressed or eliminated.

In other words, the ribbon flange 70 is an element provided inside the side walls of the casing that is the exterior of the printer 100 and inwardly retracted in the width direction from the outer surface of the casing as described above. A certain amount of space can be formed between the outer surface of the casing and the ribbon flange 70, and the lock member 80 is provided within the space. Therefore, the size of the printer in the width direction can be suppressed compared to one in which the lock member is arranged with the winding gear 61 and the gear train 90 in the axial direction thereof.

In the printer 100 according to the above embodiment and the modification, the cam faces 74 are formed on the inner side than the outer circumferential surface (outer contour) of the ribbon flange 70. However, in the printer according to the present disclosure, the cam faces 74 may be formed on the outer circumferential surface (outer contour) of the ribbon flange 70. In other words, the outer circumferential surface (outer contour) of the ribbon flange 70 itself may be the cam faces 74.

What is claimed is:

1. A printer comprising:

a body;

a cover configured to open and close relative to the body;

a winding shaft provided in the cover for winding an ink ribbon;

a regulation member provided in the cover and configured to change a position in accordance with an open and closed state of the cover;

a passive member connected to an end of the winding shaft and configured to receive driving force; and a ribbon flange provided axially inside the passive member and configured to rotate with the winding shaft, wherein the ribbon flange comprises a cam face with a contour whose radial distance from an axis center of the winding shaft varies in accordance with a rotation angle position of the ribbon flange, and wherein the regulation member is configured to contact the cam face to restrict a rotation of the ribbon flange to one direction when the cover is open.

2. The printer according to claim 1, wherein the regulation member is configured to allow a rotation of the winding shaft in a direction to wind the ink ribbon and restrict the rotation of the ribbon flange in a direction to unwind the ink ribbon to prevent the rotation of the winding shaft.

3. The printer according to claim 1, or 2, wherein the ribbon flange comprises a recess on an outer surface in a width direction of the ribbon flange, and the cam face is an inner circumferential surface of the recess.

4. The printer according to claim 3, wherein the regulation member comprises a portion that is located within the recess to contact the cam face.

5. The printer according to claim 4, wherein the cam face comprises:

a first cam face configured to contact a flat portion of the regulation member, the first cam face being a flat surface;

a second cam face that outwardly protrudes toward the regulation member, and a third cam face configured to connect the first cam face and the second cam face.

6. The printer according to claim 5, wherein the regulation member is configured to move in open and close directions of the cover, and wherein the regulation member comprises a chamfered surface at an end of the flat portion in a direction where the rotation of the ribbon flange is restricted.

7. The printer according to claim 3, wherein the ribbon flange comprises a separating portion in a radially outer area on an inner surface of the ribbon flange that is opposite to the outer surface of the ribbon flange, the separating portion placed in the radially outer area further away from the ink ribbon than a radially inner area, and wherein the recess is formed at a location to planarly overlap the radially inner area but not to planarly overlap the separating portion.

8. The printer according to claim 7, wherein the separating portion is continuously formed in the radially outer area over an entire circumference of the ribbon flange.

* * * * *